US007364538B2

(12) United States Patent
Aucamp

(10) Patent No.: US 7,364,538 B2
(45) Date of Patent: Apr. 29, 2008

(54) MOBILE EXERCISE EQUIPMENT

(76) Inventor: Fredrick P. Aucamp, 3928 Oakridge Cir., Virginia Beach, VA (US) 23451

( * ) Notice: Subject to any disclaimer, the term of this patent is extended or adjusted under 35 U.S.C. 154(b) by 36 days.

(21) Appl. No.: 11/485,907

(22) Filed: Jul. 13, 2006

(65) Prior Publication Data

US 2007/0015644 A1 Jan. 18, 2007

Related U.S. Application Data

(60) Provisional application No. 60/698,645, filed on Jul. 13, 2005.

(51) Int. Cl.
*A63B 21/00* (2006.01)

(52) U.S. Cl. ..... 482/131; 482/91; 482/139; 482/908

(58) Field of Classification Search ..... 482/16, 482/82, 91, 92, 120, 122, 123, 126, 130, 482/131, 139, 146, 24, 906, 907, 908
See application file for complete search history.

(56) References Cited

U.S. PATENT DOCUMENTS 3,369,809 A * 2/1968 Morrill, Jr. ..... 482/91
3,690,654 A * 9/1972 Hepburn et al. ..... 482/116
3,764,132 A * 10/1973 Hepburn ..... 482/123
3,843,119 A * 10/1974 Davis ..... 482/131
3,861,215 A * 1/1975 Bradley ..... 482/116
4,077,626 A * 3/1978 Newman ..... 482/110
4,257,592 A * 3/1981 Jones ..... 482/131
4,645,204 A * 2/1987 Berger ..... 482/123
4,787,630 A * 11/1988 Watson et al. ..... 482/146
4,944,511 A * 7/1990 Francis ..... 482/123
5,171,295 A * 12/1992 Schwalm, Jr. ..... 482/131
5,261,864 A * 11/1993 Fitzpatrick ..... 482/52
5,429,572 A * 7/1995 Brown et al. ..... 482/116
5,447,484 A * 9/1995 Chandler ..... 482/146
5,556,369 A * 9/1996 Roberts ..... 482/131
6,315,701 B1 * 11/2001 Shifferaw ..... 482/114
6,612,170 B2 * 9/2003 Brown ..... 73/379.06
2004/0053756 A1 * 3/2004 Tremayne ..... 482/126

* cited by examiner

*Primary Examiner*—Joseph S Del Sole
*Assistant Examiner*—Daniel F Roland
(74) *Attorney, Agent, or Firm*—Goldizen & Associates; Bradley D. Goldizen

(57) ABSTRACT

An exercise device includes a pair of formed handles including openings through which ends of a rope or cord are passed. The rope to one handle is knotted and the rope to the other handle is adjustable but becomes fixed when the rope and the handle are firmly grasped. The base is a platform in which part of the user's body maintains contact with during an exercise. The base includes a channel through which the rope passes. Pulleys are positioned on either side of the platform at either end of the channel.

2 Claims, 7 Drawing Sheets

MOBILE EXERCISE EQUIPMENT

The present application claims priority from U.S. Provisional Patent Application Ser. No. 60/698,645 that was filed on Jul. 13, 2005.

The subject matter of the present invention did not receive federal government research and development funding.

BACKGROUND OF THE INVENTION

The present invention generally related to exercise equipment that may be easily stored and carried. More particularly, the present invention relates to a piece of variable resistance exercise equipment that includes a base and a pair of opposing handles. The opposing handles are coupled together via a cable for conducting an array of exercises. One of the handles is arranged to allow a user to easily adjust the length of the cable to accomodate a variety of exercises. By providing a longer length of cable between the handles, the adjustability of the device is greatly enhanced and a single device may be produced for a plurality of different sized individuals.

There exists a need for providing a compact and light weight exercise device that can be easily stored and transported. Moreover, there exists a need for providing an exercise device that is easily adjusted to allow a user to perform a variety of exercises without the use of a complex adjustment means. The level of resistance in the present device may be varied according to a level of resistance provided by an opposing arm or its associated muscles.

SUMMARY OF THE INVENTION

The present invention is an exercise device that comprises a base upon which the user places his feet, back or other part of his body when different exercises are performed. The base includes a groove, trough, channel, chase or raceway for accommodating a rope or cable that connects a pair of handles together in an adjustable manner. Throughout the following discussion, the terms "rope" and "cable" are used interchangeably and should be interpreted broadly to include an elongated flexible member that connects the handles together. The raceway extends through the base in a left-to-right manner and includes two openings on either side of the base at ends of the raceway. A pair of pulleys attach to the base which comprises step-wise edges arranged on either side of the base. A first pulley is arranged on a first side of the base near a first opening of the raceway and on the lower shelf of the base arranged on the left side of the base. A second pulley is arranged on a second side of the base near a second opening of the raceway and on the lower shelf of the base arranged on the right side of the base. The second opening of the raceway is provided on an opposite side from the first opening. The pulleys are arranged to accept the cable that couples the handles together in a manner that allows the cable to extend between the pulleys. In this fashion, force exerted by one arm is transferred through the cable to the other arm. This force may be manipulated to easily vary the tension created on the cable when the handles are pulled apart from one another.

The exercise device includes a novel adjustment means that modifies the length of cable arranged between the handles. The adjustment means comprises a first handle, an "adjustable handle," that includes four holes or openings through which the cable passes. The first hole is preferably arranged at the center bottom of the handle. The second hole is arranged near the bottom of one of the vertical sides of the handle. The third hole is near the top of the same vertical side of the handle as the second hole. The fourth opening is near the top of the handle on an opposite vertical side as the third opening. The cable passes through the first opening at the bottom into a hand opening defined by the four sides that form the handle. The cable then passes through a second hole arranged in the side of the handle. The cable next passes along the exterior of the handle to extend from the second hole to the third hole. The cable re-enters the hand opening via the third opening and extends across an interior top side of the handle. The second and third openings act as frictional brakes and prevent any tension between the two handles from being transferred into the cable that is arranged along the interior top side of the handle and which is squeezed against the interior side of the handle by the hand and fingers of the user. This arrangement provides for an adjustable cable length which becomes fixed when one firmly grasps the cable and pinches it against the top of the handle, which is defined as a side of the handle between the third and fourth openings. The other handle is the "fixed" handle and has one opening at the bottom center for receiving an opposite end of the cable. The opposite end of the cable passes through this opening and is knotted with a washer so that it may not be pulled back through the opening.

The present invention may be used to perform at least a plurality of exercises that include chest, shoulder, back, arm, leg and the torso muscles. The length of the cable or rope is adjustable to accommodate different-sized individuals and different exercises such that the device is manufactured in a universal size. The resistance for a particular exercise is the counter force applied by the arm or opposing body part that is moved in a manner to counter the other arm or other body part doing the exercise movement. This resistant can be varied from repetition to repetition or varied during an individual repetition. The device may also be used for isometric training, i.e. exertion of force without movement.

It is an object of the invention to provide an exercise machine that is easily stored, lightweight and mobile. Preferably, the base and handles are constructed of lightweight plastic, composite or the like.

BRIEF DESCRIPTION OF THE DRAWINGS

FIG. 3 is a view of a one arm press exercise that may be performed with the invention.

FIG. 4 is a view of a lateral raises exercise that may be performed with the invention.

FIG. 5 is a view of a bent over rowing exercise that may be performed with the invention.

FIG. 6 is a view of a one arm curl exercise that may be performed with the invention.

FIG. 7 is a view of a triceps extension exercise that may be performed with the invention.

FIG. 8 is a view of a chest press exercise that may be performed with the invention.

FIG. 9 is a view of a chest lateral exercise that may be performed with the invention.

FIG. 10 is a view of a side bend exercise that may be performed with the invention.

FIG. 11 is a view of an abdominal curl exercise that may be performed with the invention.

DETAILED DESCRIPTION OF THE INVENTION

For ease in understanding the invention, the device 1 has been defined as having a left side "L" and a right side "R" when being viewed from the front. It should be noted that interpretation of the invention should not be limited to particular discussed or claimed elements being on a particular side of the invention. It should be recognized that the device may still be used when the front and back or left and right sides are reversed. This the adjustable handle of the device, referenced hereinafter as handle 3A, to be used by the dominant or desired hand.

Figure 1:
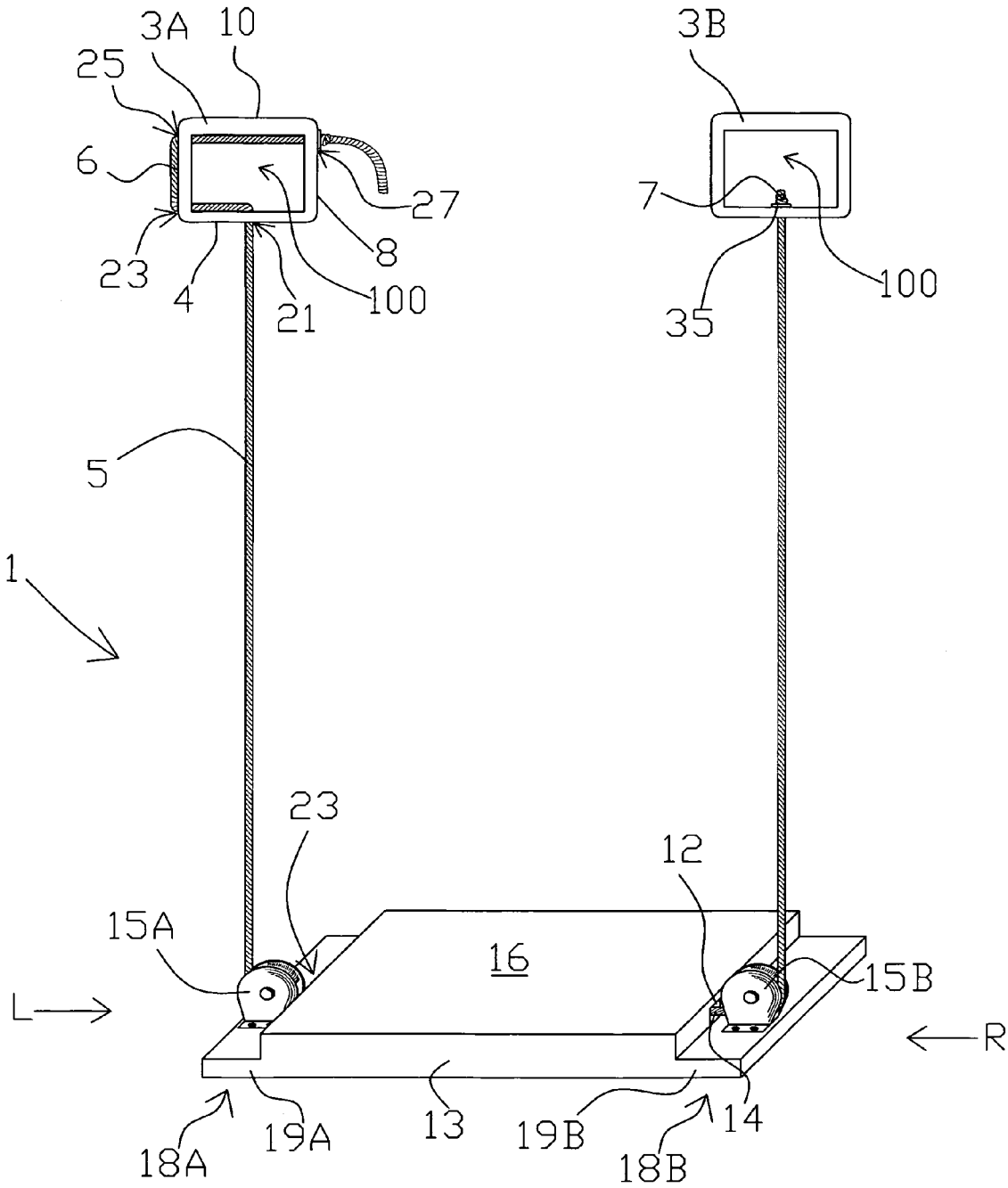
FIG. 1 is a perspective view of the exercise equipment.
Figure 2:
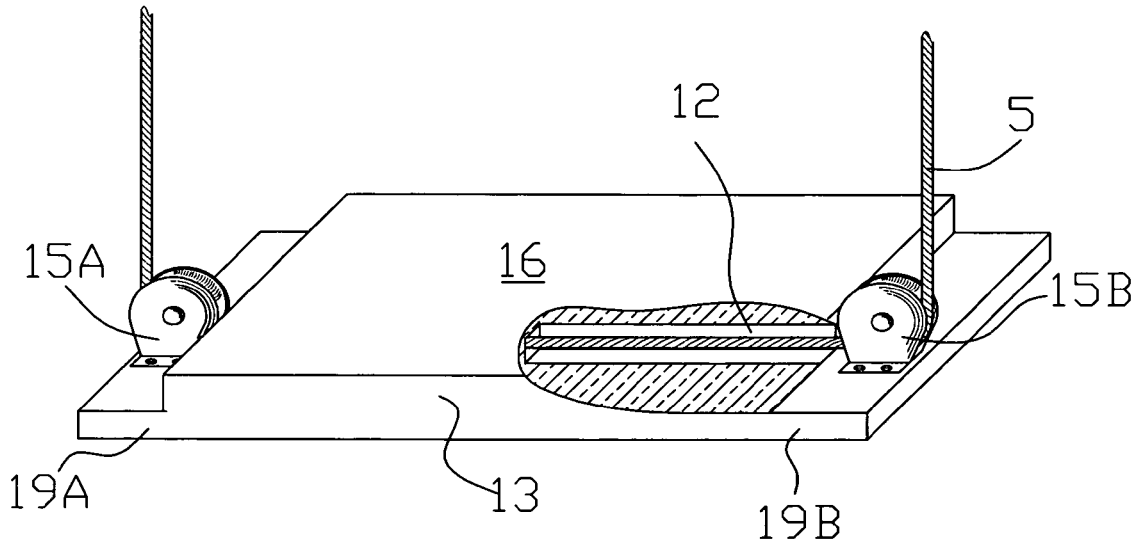
FIG. 2 is a partial exposed view of the base and showing the raceway and rope traveling therethrough.

FIG. 1 is a perspective view of the exercise device 1. The device 1 comprises a base 13 that includes a raised or platform area 16 that is centrally located within the base 13. A covered raceway 12, having openings 14, 23 arranged on either end thereof, extends through the platform area 16. Opening 23 is not actually depicted in the drawings, but arrow 23 denotes its general location. Left and right sides, respectively denoted as "L" and "R" in FIG. 1, include shelf 19A and shelf 19B as shown. The shelves 19A and 19B, collectively referred to as 19, are shorter in height than platform 16. This creates step-wise edges 18A, 18B, as shown in the figures. A rope 5 passes through the covered raceway 12 as more clearly shown in FIG. 2. The rope 5 passes through a pair of pulleys 15 arranged on either side of the base 13 on an upper edge of shelves 19. A first pulley 15A is arranged on a first side, "L", of the base 13 near a first opening 23 of the raceway 12 and on the lower shelf 19A. A second pulley 15B is arranged on a second side "R", of the base 13 near a second opening 14 of the raceway 12 and on the lower shelf 19B. The second opening 14 of the raceway is provided on an opposite side from the first opening 23. The pulleys 15A, 15B are arranged to accept the rope 5 that couples the handles 3A, 3B together in a manner that allows the rope 5 to extend between the pulleys 15A, 15B.

The adjustable rope 5 passes through a first opening 21 formed at the bottom 4 of handle 3A to run along an interior of hand opening 100. Handle 3A comprises a bottom side 4, a first vertical side 6, a top side 10 and a second vertical side 8. These four sides create a hand opening 100. The rope 5 progresses from the first opening 21 through a second opening 23 formed near the bottom of side 6 and runs along an exterior edge of first vertical side 6. Rope 5 then passes through a third opening 25 into the hand opening 100. Rope 5 next passes along an interior edge of top 10 and through the fourth opening 27. The end of the rope which is fixed at the other handle 3 passes through the bottom center of that handle 7 thence through a washer 35 and is knotted to prevent the rope from being pulled back through the hole. The handles preferably comprise a rigid material.

Figure 3:
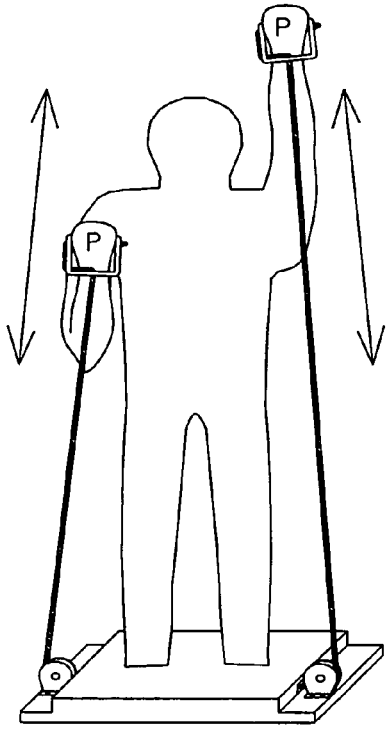
FIGS. 3 through 11 depicts some of the exercises that may be performed on this device.

FIG. 3 denotes a first exercise that may be performed with the exercise device 1. In this exercise, the user stands erect on the base such that his toes or the balls of his feet are centered between the pulleys. He grasps the handles with his palms facing away from his body as indicated by "P". The arms are fully flexed with hands in front of the shoulders. One arm is pushed upward while the other is drawn downward toward a pulley. This motion is then repeated such that the other arm is raised as the opposite arm is lowered in a climbing motion, as indicated by the arrows.

Figure 4:
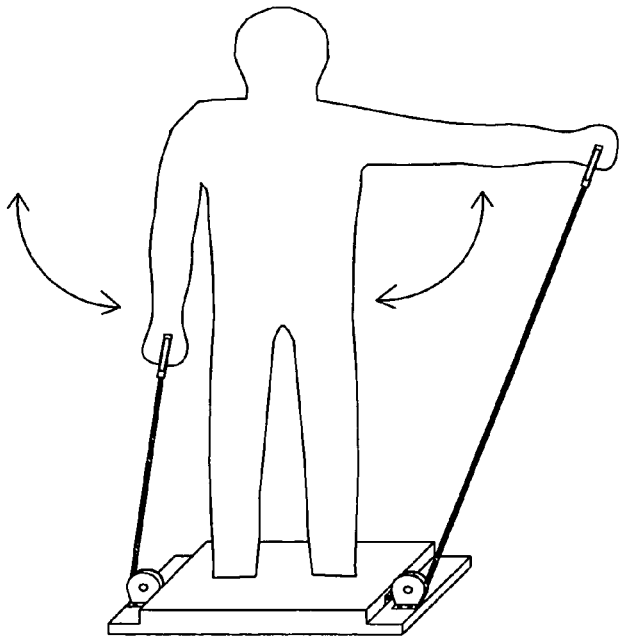

In FIG. 4, the user stands erect with his palms facing his sides. An arm is kept straight while being raised to a substantially perpendicular, horizontal angle relative to the vertical height of the user. The arm is lowered while being kept straight; simultaneously, the opposite arm is raised in the manner previously mentioned and as indicated by the arrows.

Figure 5:
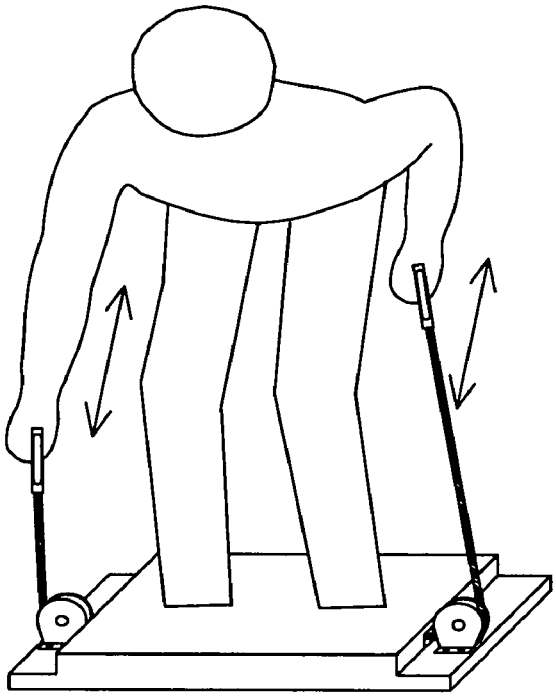

In FIG. 5, the user stands bent over at the waist while maintaining a straight back. The user's palms face his sides. One arm is raised by bending it at the elbow; the other arm is then straightened. The exercise is repeated by reversing the order of exercise of each arm. This exercise is a rowing motion that works the upper back and shoulders.

Figure 6:
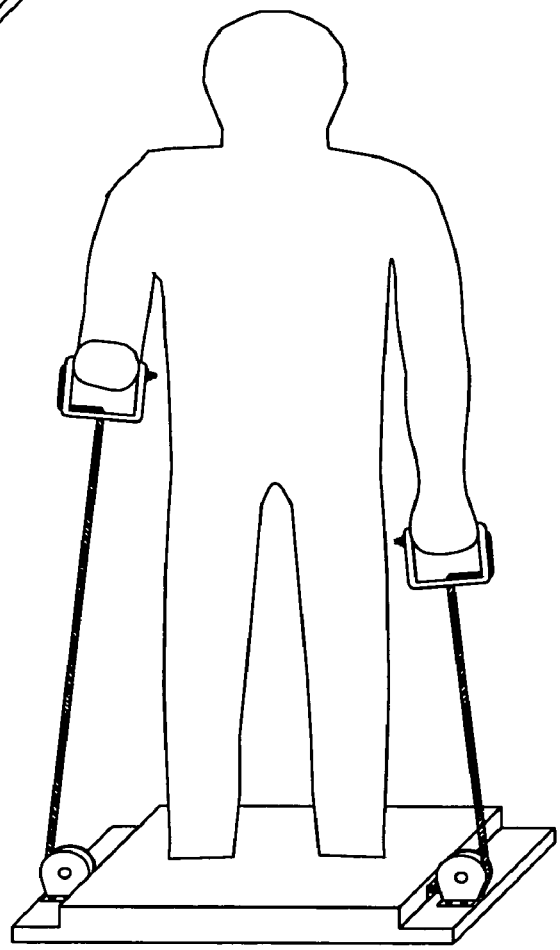

In FIG. 6, the user performs bicep curls. The user stands erect with his palms facing forward in an underhand fashion, as shown. The first arm is raised as the other is lowered while keeping the elbows stationary. The other arm is then raised while the first arm is lowered.

Figure 7:
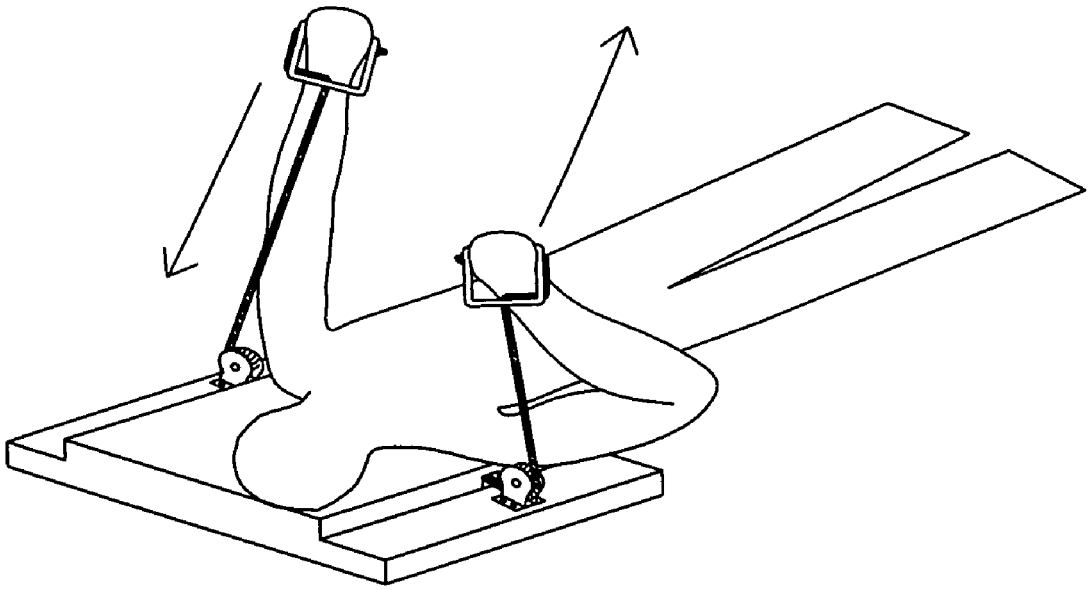

In FIG. 7, the user is lying on the platform with his palms facing up and each arm bent. While keeping elbows stationary, one arm is extended until it is straight; while, the hand on the other is pulled towards the respective pulley. The motion of the arms are then reversed and alternated.

Figure 8:
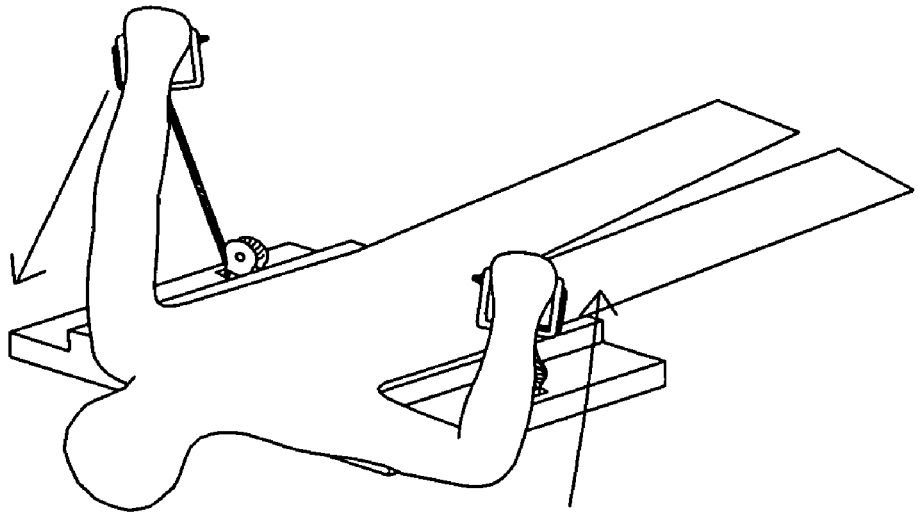

In FIG. 8, a chest press exercise is executed. The user lies on his back with the platform under his upper back. One arm is straight with a palm facing forward towards his feet. The other arm is bent with the arm facing forward. The straight arm is bent while the bent arm is straightened.

Figure 9:
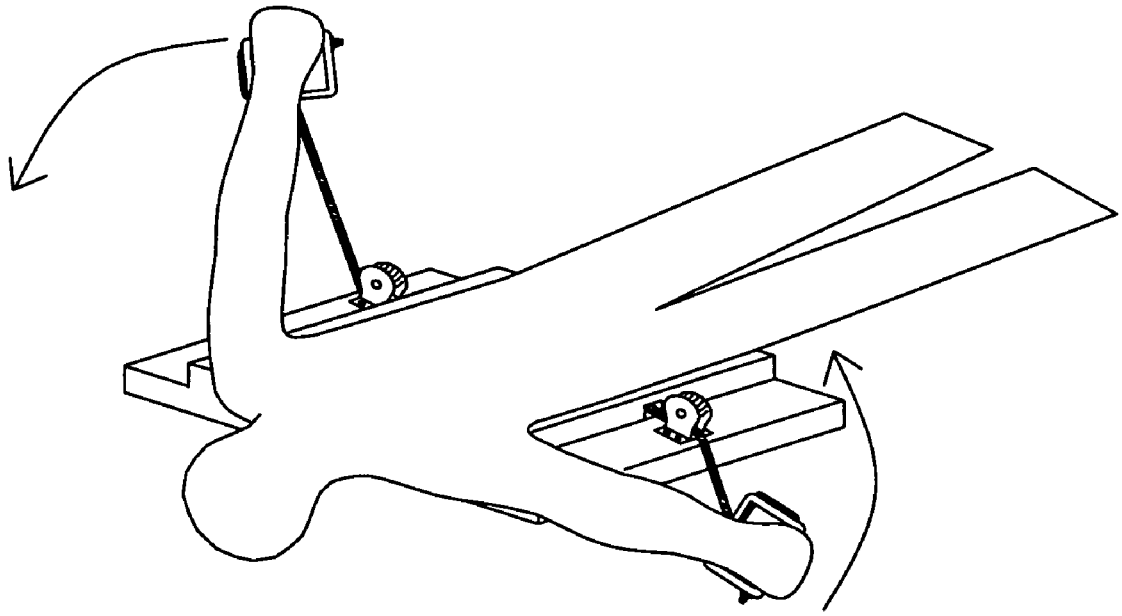

In FIG. 9, another chest exercise is performed when the user lies on his back as shown. Both arms are straightened with one extended to the side on the floor and the other extending away from and above the body. The arm on the floor is swung upward while the other arm is lowered to the floor.

Figure 10:
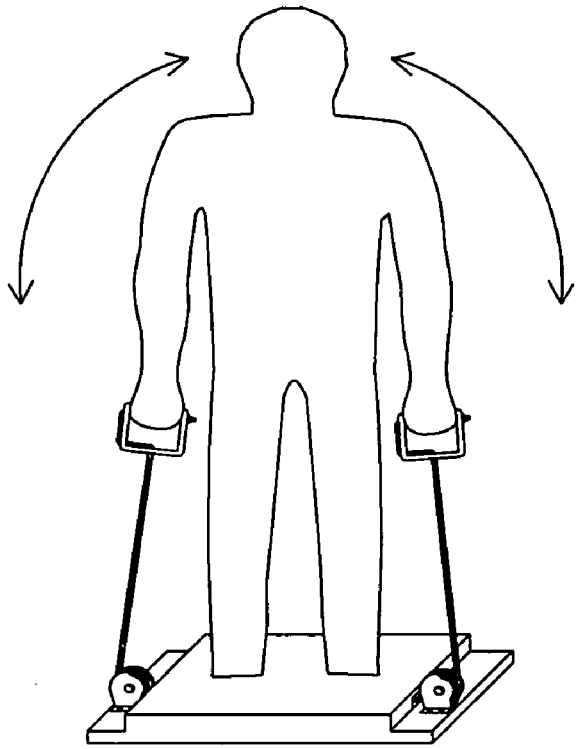

In FIG. 10, the user performs side bends. The user stands in an erect manner with his arms at his sides and palms facing his sides. He bends his upper body or torso from side to side while keeping his arms straight and his feet stationary, as shown.

Figure 11:
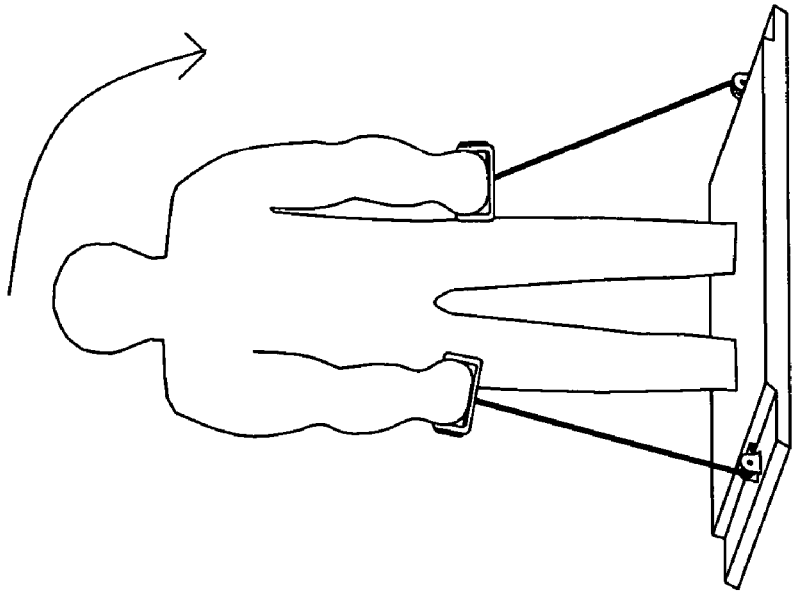

In FIG. 11, the user lies on his back with his feet on the platform. It should be noted that the platform is standing on edge when this exercise is performed. The upper arms are kept on the floor. The upper arms remain stationary while the lower arms are pulled away from the platform. The shoulders are crunched up while the abdominal muscles are tightened and flexed while raising the head off the ground.

While the invention has been described with respect to preferred embodiments, it is intended that all matter contained in the above description or shown in the accompanying drawings shall be interpreted as illustrative and not in limiting sense. From the above disclosure of the general principles of the present invention and the preceding detailed description, those skilled in the art will readily comprehend the various modifications to which the present invention is susceptible. Therefore, the scope of the invention should be limited only by the following claims and equivalents thereof.

I claim:

1. An exercise device comprising:

a base that includes a raised platform area, said platform area including a covered raceway and a first opening arranged at a first end of the covered raceway and a second opening arranged at a second end of the covered raceway, said base further comprising a first shelf arranged at the first end of the covered raceway and a second shelf arranged at the second end of the covered raceway;

a first pulley arranged on the first shelf;

a second pulley arranged on the second shelf;

a first handle forming a hand opening having a top side, a bottom side, a left vertical side and a right vertical side, at least one hole arranged in the bottom side for receiving a cable said first handle further includes a hole arranged in the left vertical side near the bottom side, a second hole is arranged in the left vertical side near the top side, a third hole is arranged in the right vertical side near the top side;

a second handle forming a hand opening having a top side, a bottom side, a left vertical side and a right vertical side, at least one hole arranged in the bottom side for receiving a cable; and, a cable passing through the first and second pulleys and having a first end fastened to the first handle and a second end fastened to the second handle;

wherein said cable extends from the hole arranged in the bottom side of the first handle to run along an interior surface of the bottom side, said cable extending through the hole arranged in the left vertical side near the bottom side to run on an exterior edge of the left vertical side, said cable further extending through the hole arranged in the left vertical side near the top side to run along an interior edge of the top side of the first handle and thereafter exit the hand opening via the third hole arranged in the right vertical side.

2. The exercise device of claim 1 wherein said base includes step wise edges.

* * * * *